US005218347A

United States Patent [19]

Deppe

[11] Patent Number: 5,218,347

[45] Date of Patent: Jun. 8, 1993

[54] APPARATUS FOR DETECTING HAZARDOUS GASES

[75] Inventor: Daniel F. Deppe, Lindale, Tex.

[73] Assignee: Lindale Industries, Inc., Lindale, Tex.

[21] Appl. No.: 791,574

[22] Filed: Nov. 12, 1991

[51] Int. Cl.[5] ..... G08B 17/10

[52] U.S. Cl. ..... 340/634; 73/31.06

[58] Field of Search ..... 340/634; 73/31.06; 204/425-427

[56] References Cited

U.S. PATENT DOCUMENTS

| | | | |
|---|---|---|---|
| 3,695,848 | 10/1972 | Taguchi | 340/634 X |
| 4,327,361 | 4/1982 | Berlin | 340/634 |
| 4,335,379 | 6/1982 | Martin | 340/634 |
| 4,458,242 | 7/1984 | Kusanagi et al. | 340/634 |
| 4,517,161 | 5/1985 | Gravina et al. | 73/31.06 X |
| 4,644,333 | 2/1987 | Barendsz et al. | 340/634 |
| 4,652,831 | 3/1987 | Ferraro | 324/464 |
| 4,659,435 | 4/1987 | Brothers et al. | 204/425 X |
| 4,747,009 | 5/1988 | Gillett et al. | 361/165 |
| 4,800,292 | 1/1989 | Gillett | 307/117 |
| 4,818,977 | 4/1989 | Alexander | 340/633 |
| 4,905,498 | 3/1990 | O'Donnell et al. | 73/23.3 X |

OTHER PUBLICATIONS

G. R. Lewis, Low-Cost Temperature Controller Built with Timer Circuit, Aug. 16, 1975, Electronic Design.

TLC 555 Timer, Archer, Technical Data, Catalog Number 276-1718, Aug. 2, 1991.

Semiconductor Gas Sensor, Figaro Engineering, Inc., Not Dated.

Watson, J., et al *Applications of the Taguchi gas sensor to alarms for inflammable gases* On Radio & Electronic Engineer, vol. 44, No. 2, Feb. 1974, pp. 85-91.

*Primary Examiner*—Hezron E. Williams

*Attorney, Agent, or Firm*—Hubbard, Thurman, Tucker & Harris

[57] ABSTRACT

A new and improved gas detection, concentration and warning apparatus is disclosed which includes a tin dioxide semiconductor gas sensor operated with a load resistor of a preselected value and power source for producing reliable and consistent gas concentration voltage output for either a voltmeter having a dial calibrated to read the voltage and indicate corresponding gas concentrations for a portable work site apparatus or to trigger and threshold inputs to a 555 timer where first and second state outputs are connected to either a sound alarm for a home apparatus or to light or sound or both alarms located in a vehicle dashboard for a natural gas fueled vehicle. For vehicle use, multiple gas sensor circuits are used with their probes located under the vehicle hood and in the supply tank compartment (trunk).

11 Claims, 2 Drawing Sheets

APPARATUS FOR DETECTING HAZARDOUS GASES

This invention relates to a hazardous gas detecting apparatus, and more particularly to an apparatus for detecting the presence of a combustible gas in concentrations at a preselected level below the lower explosive limit (LEL) for the gas.

In the past combustible gases which are colorless and odorless, such as natural gas, have been mixed with a mercaptan. The mercaptan has an intensely disagreeable odor readily detectable by a person's sense of smell. However, if no one is around to detect the gas, it can accumulate to an explosive level and a spark from automatically turned on electrical devices can touch it off.

Other methods have been used to detect hazardous gases. Examples are: (1) color indication of chemical reaction in a detecting tube; (2) optical interference; (3) infrared absorption (spectrum); (4) heat generation from catalytic reaction on a hot wire (platinum); and (5) semiconductor sensors employing metal oxides.

Of these methods all but the metal oxide semiconductor detector suffer from problems such as difficulty in handling maintenance, high cost and limited life expectancy.

The semiconductor sensor employing metal oxide is a very simple detector. A gas sensor employing tin dioxide ($SnO_2$) as an additive is produced by Figaro Engineering, Inc., Osaka, Japan, under the commercial name of "TGS". Desirable features of TGS gas sensors include: (1) suitability for detecting gases with low concentration; (2) long life, high stability and high resistance against corrosive gases; (3) repeatability of results; (4) low cost, reliability and stability for shock and vibration; and (5) direct transformation from gas concentration to electrical signal through a change of conductivity.

The TGS gas sensors are either directly or indirectly heated sensors which include a 100-mesh stainless steel gauze (double) as a flameproof cover, noble metal wire sensor leads, sensor, sensor heater coil resin molding, and nickel pin connectors.

When the TGS sensor is heated at a certain high temperature in the air, oxygen, which can accept electrons, is disassociatively absorbed on the surface having a negative charge which has resulted from an electron transfer from the donor levels in the surface region. As a result, the electron depletion layer develops from the surface to the bulk and is positively charged so as to balance the surface negative charge which oxygen has. Then, potential barriers against bulk conductive electrons are formed at the grain boundaries of the centered body. The barrier prevents the electrons from moving at the grain boundaries so that the sensor has a very high resistance.

However, when a hazardous gas is supplied to the sensor in air, it absorbs on the sensor surface and reacts with absorbed oxygen. This results in decreased potential barriers formed by the absorbed oxygen. Therefore, the sensor resistance decreases in proportion to gas concentration.

The response for various gases is altered by the sensor element's temperature and minute components added to tin dioxide semiconductor materials. Thus, different types of TGS sensors with their own relative sensitivities have been produced by controlling the temperature and added materials.

If the supply voltage (Vc) is less than 24 V, the load resistance has no essential effect on the sensitivity characteristics if the sensor power consumption (Pc) is under 15 mV.

The range of the gas concentration when the output voltage change per concentration is maximum can be controlled by the combination of sensor resistance level and load resistance. Thus, it is necessary to choose the proper RL in the detection range of gas concentration in order to increase the precision of measurements and detection.

Another important factor of correct sensor usage is the treatment of the signal output signal. The conventional method is to directly and simply examine the sensor output signal as it is. Another method to treat a signal is the reference signal method. The output signal in the clean atmosphere is employed as a reference signal.

The conventional method uses a circuit which includes a power supply, a TGS sensor and load resistor, and an alarm responsive to the sensor's output.

The reference signal method includes a comparator having its minus (−) input connected to a reference voltage and its positive (+) input connected to the sensor's output. Thus, when the voltage exceeds the difference voltage, the comparator outputs a difference signal to turn on a power transistor to power on alarms. In these methods it has been believed necessary to include a thermistor type circuit for temperature and humidity compensation. Further, because immediately after switch on a false alarm occurs until the sensor stabilizes, an alarm suppression circuit has been used. Also, because the sensor might fail or an associated component might fail, a failure detection circuit has been included. Those persons skilled in the art desiring more information for such a system are referred to U.S. Pat. No. 4,007,456 issued Feb. 8, 1977, to Paige, et al., for a Gas Detecting and Warning System.

The above described apparatus suffers from its cost of manufacture and maintenance of its complex circuitry. Further, known gas detecting devices are not considered practical for use by home repairmen or use as multiple devices in homes and gas fueled vehicles.

Accordingly, it is an object of this invention to provide a low cost, reliable, substantially maintenance free apparatus for detecting hazardous gases.

Another object of the invention is to provide an apparatus for detecting the presence of a combustible gas whose concentration in air is substantially below its lower explosive limit (LEL).

Still another object of the invention is to provide a portable apparatus for detecting the presence and concentration of a combustible gas in air for use by maintenance personnel entering a potentially hazardous work place.

SUMMARY OF THE INVENTION

In accordance with a first embodiment of this invention, a portable apparatus is provided for determining the presence of a concentration of a hazardous gas. The apparatus includes a metal oxide semiconductor sensor whose resistance variation per unit concentration is large in a lower concentration range. Circuitry connected to the sensor detects the applied voltage and the voltage variations resulting from the variations of resistance within the sensor and displays the variations in voltage and corresponding gas concentrations.

In a second embodiment, an apparatus for detecting a hazardous gas in concentrations well below its lower explosive limit includes an SnO2 semiconductor sensor probe for placement with respect to a potentially hazardous site. A load resistor is connected to the sensor to form an external resistor network. The heat resistance of the sensor and the resistance of the load resistor is empirically determined to provide a voltage output indicative of the selected gas concentration. The selected gas concentration is ten percent (10%) of the gas lower explosive limit. For natural gas which has an LEL of 50,000 parts per million (ppm), the selected gas concentration is 5,000 ppm. A subcircuit is provided which includes two comparators, a latch and an internal resistance network. The output of the external resistor network is connected to corresponding first terminals of the two comparators, and outputs of the internal resistor networks are connected to corresponding second terminals of the two comparators. The outputs of the two comparators are connected to the latch. Thus, as the voltage across TGS sensor changes in proportion to gas concentrations, the latch is first in an off state and when the voltage reaches the set point voltage (set to correspond to the gas concentration to be detected) the latch goes on to power the alarms. In the second embodiment light and sound alarms are recommended.

In a third embodiment which is suitable for use in gas fueled vehicles, two apparatuses of the second embodiment are used. The probe of one apparatus is located under the engine hood adjacent to the carburetor system for detecting leaks and the probe of a second apparatus is positioned in the tank compartment (trunk) adjacent to the tank to detect gas leaks. The signal processing circuits of the two apparatuses are combined in a single housing together with the alarms. The housing is mounted either in or under the vehicle's dashboard for vehicle operator sensing. In the third embodiment the alarms may be either light or sound alarms or both as desired. Where passengers are apt to panic as in, for example, a school bus, the sound alarms are omitted.

BRIEF DESCRIPTION OF THE DRAWINGS

The above and other features and advantages of this invention will become more apparent as the invention becomes better understood by the detailed description that follows, when considered in connection with the drawings in which.

DETAILED DESCRIPTION OF PREFERRED EMBODIMENTS

For purposes of description only and not by way of limitation, the preferred embodiments will be described in conjunction with the detection of natural gas. The values given for the parts are those determined to provide an operative apparatus for the detection of natural gas.

Figure 1:
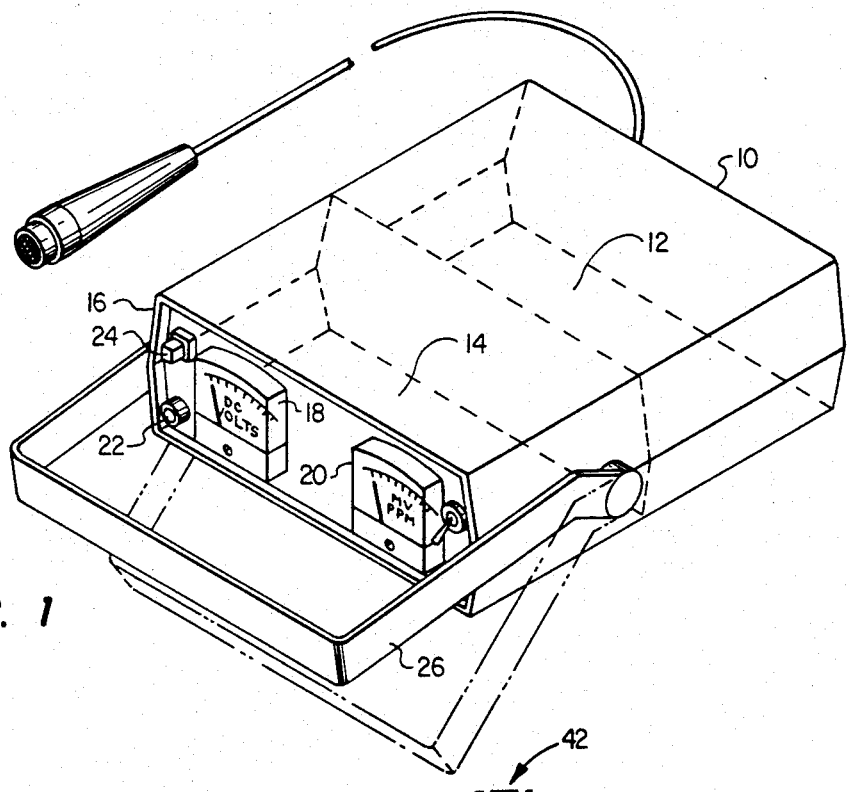
FIG. 1 is an isometric view of the portable hazardous gas detection apparatus constituting the first embodiment of the invention.

As shown in FIG. 1, the portable hazardous gas sensing and concentration determination apparatus includes a portable plastic (polyvinylchloride, for example) housing 10, having a power supply compartment 12 and circuit compartment 14 adjacent to a front end, and a front end 16 to which first and second voltmeters 18 and 20, a power on indicating light reflector 22, and a push ON/OFF switch 24 are attached.

The first voltmeter 18 is for measuring the regulated voltage supply and the second voltmeter 20 is for measuring the voltage output of a TGS 813 sensor manufactured by Figaro Engineering, Inc. The dial of voltmeter 18 is calibrated in volts and the dial of voltmeter 20 is calibrated in millivolts (mV) with the gas concentration for each calibration indicated. Thus, the presence of the proper power supply voltage on meter 18 provides a check on the accuracy of the ppm. reading of the second meter 20.

A position adjustable handle 26 is attached to the sides of the housing 10 adjacent to the front end. The position of the handle may be adjusted from an in line carrying position to a house supporting position for supporting the front end of the housing above a support surface to facilitate meter reading.

Figure 2:
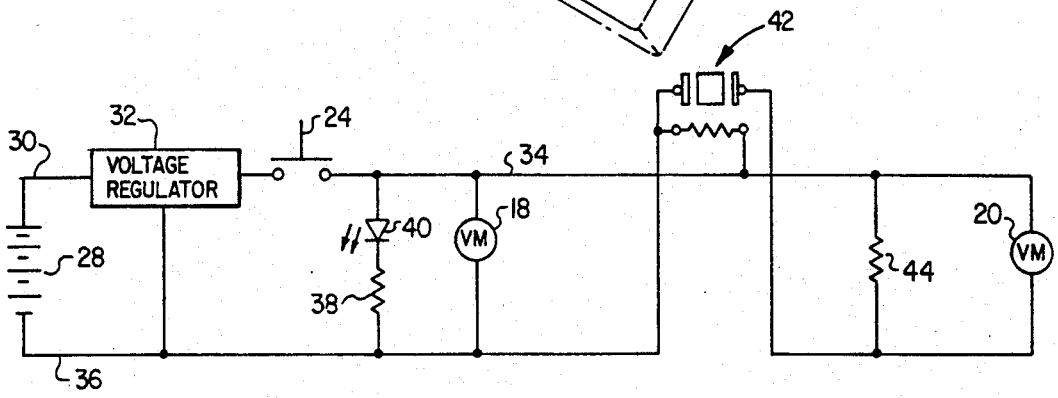
FIG. 2 is a schematic view of the electrical circuit for the hazardous gas detection apparatus of the first embodiment of the invention.

Referring now to FIG. 2, the power supply is preferably a 12 volt dc rechargeable battery 28 mounted in the battery compartment 12 of housing 10 (FIG. 1). The positive terminal of the battery 28 (FIG. 2) is connected by lead 30 to the ground terminal of a voltage regulator 32. The input terminal of the voltage regulator is connected to a first contact of the push ON/OFF switch 24. The second contact of switch 24 is connected to return lead 34.

The negative terminal of battery 28 is connected by lead 36 to the junction of the output terminal of the voltage regulator 32, 330 ohm voltage dropping resistor 38 which in turn is connected to a light emitting diode (LED) 40 to provide light for the power on light reflector 22 (FIG. 1), voltmeter 18 (FIG. 2), and the heating coil and first electrode of the ga detector sensor 42 and return through lead 34. The gas detector sensor is a TGS 813 sensor.

The second electrode of the TGS sensor 42 is connected to the junction of a 15K ohm load resistor 44 and the voltmeter 20.

In operation when switch 24 is pushed ON, 12 V power from the battery 28 is applied to the voltage regulator which applies a constant 5 V as measured by the voltmeter 18 to the coil heater and first electrode both of the TGS heater 42. The 5 V is also applied to the dropping resistor for powering on the LED 40. The LED 40 preferably provides a green light indicating a power on condition.

As the heater warms the gas detecting sensor, the sensor output at the second electrode voltage is stabilized. Then, when natural gas contracts the sensor, the sensor resistance decreases in proportion to gas concentration and the corresponding voltage increase is measured by the second voltmeter 20 and the mV or gas concentration level is read from the dial of the meter by the operator.

Figure 3:
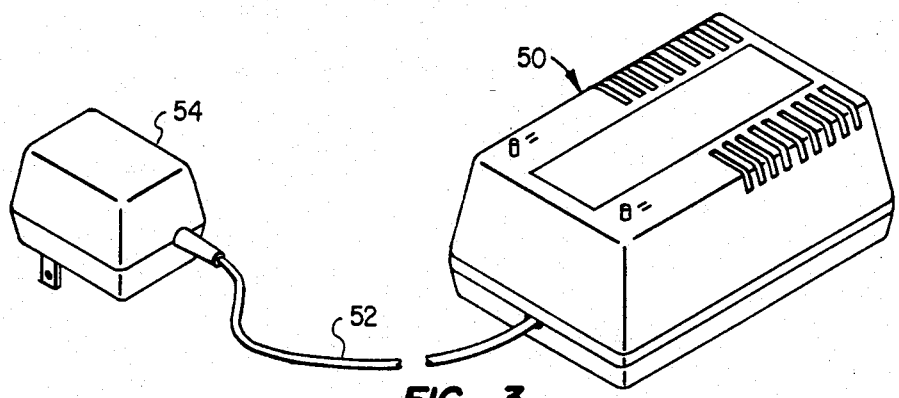
FIG. 3 is an isometric view of the hazardous gas detection apparatus constituting the second embodiment of this invention.

Referring now to FIG. 3, the natural gas sensor apparatus of the second embodiment of this invention includes an alarm signal processing housing 50 having apertures for receiving and retaining the heads of wall screws (not shown) for attachment to a selected wall of a house and for passage of electrical leads 52. The housing 50 has a power source compartment for a source of power, an alarm signal processing circuit compartment, and an audible compartment having a louvered side for outputting an alarm's sound waves, and red and green light reflectors for indicating power failure and gas detection indicators. A housing 54 is provided for the gas detecting sensor of the apparatus. The housing may be either a louvered rectangular housing or an elongated conical shaped housing (FIG. 4) having a screened open end in open communication with the sensor. Thus, the sensor and its housing 54 (FIG. 3) are connected remotely to the signal processing housing 50 by leads 52.

Figure 5:
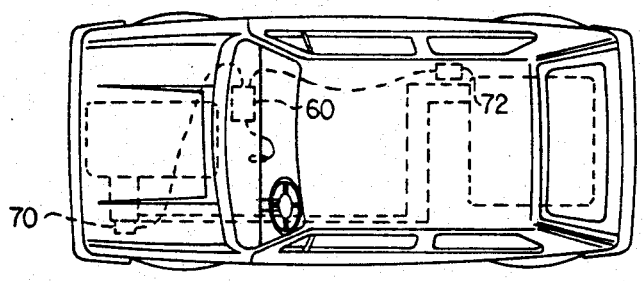
FIG. 5 is a plan view showing the positioning of the components of the hazardous gas detection apparatus of the third embodiment.
Figure 4:
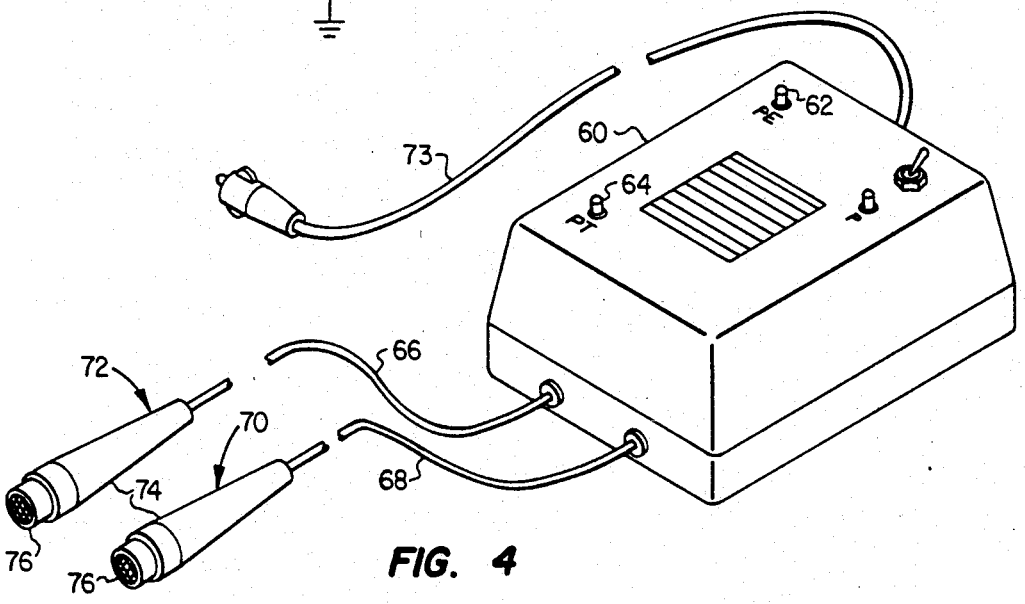
FIG. 4 is an isometric view of the hazardous gas detection apparatus constituting the third embodiment of the invention.

Referring now to FIG. 4, the natural gas sensor apparatus of the third embodiment of this invention includes a multiple alarm signal processing housing 60 having a compartment for two signal processing circuits, hereinafter described, a sound generator compartment having a louvered side for passing sound waves from a pair of buzzers connected to the signal processing circuits, and for supporting a power on and two gas detector indicating light reflectors 62 and 64 mounted adjacent to the louvers. The housing 60 has apertures leading to the signal processing compartments for receiving leads 66 and 68 of two gas detecting sensor probes 70 and 72 a lead 73 for a vehicle lighter plug in. The probes 70 and 72 include elongated conical shaped housing 74 having screened openings 76 for admitting natural gas escaping under the hood or in the tank containing compartment of a vehicle. As shown in FIG. 5, probe 70 is connected to the vehicle's front fender wall adjacent to and slightly above the carburetor system; while probe 72 is connected either to the trunk wall adjacent to and slightly above the plastic enclosure for the vehicle's tank or to the top of the plastic enclosure for the tank, if used. The positioning of the probes above the gas source is dictated by the fact that natural gas being lighter than air rises upon escaping. The multiple compartment 60 is positioned either in or under the vehicle's dashboard for monitoring by the vehicle operator. Each light alarm is labeled to identify the corresponding location of the probe such as for the engine PE and trunk TT.

The circuits of the second and third embodiments are substantially identical. The only difference might be the absence of a buzzer alarm in the third embodiment to meet customer requirements for passenger vehicles when it is believed the sound of a buzzer might panic the passengers. Accordingly, only one circuit need be described for the second and third embodiments.

Figure 6:
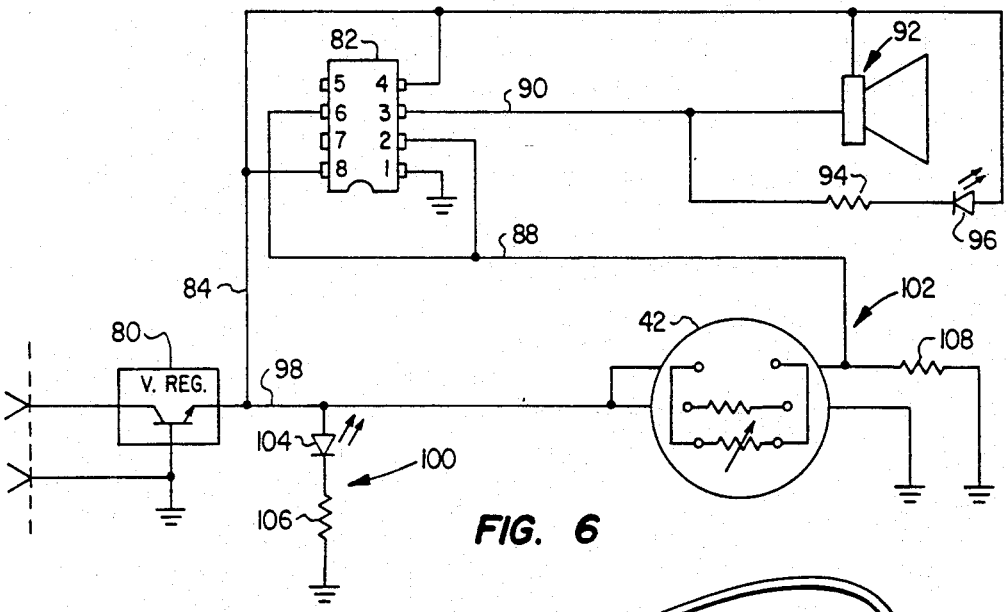
FIG. 6 is a schematic view of the electrical circuit utilized in the second and third embodiments of the invention.

Referring now to FIG. 6, the electrical circuit for the second or third embodiments of the invention includes a voltage regulator 80 which produces a constant 5 Vdc from a power source. The voltage regulator is the 78 MO5 voltage regulator manufactured by Texas Instruments, Inc., and the power source may be a 9 V battery for the second embodiment or the 12 V battery of the vehicle for the third embodiment.

The device 82 is a 555 timer circuit manufactured by the National Semiconductor Company. Line 84, which is connected to the voltage regulator, provides the Vcc (pin 8) voltage input and a constant off reset voltage input (pin 4). Line 88 is a trigger (pin 2) and threshold (pin 6) input. Discharge (pin 7) and control (pin 5) are not used. Line 90 connects the output (pin 3) to the junction of a sound alarm 92 and positive sire of a 470 ohm dropping resistor 94 whose negative side is connected to a red LED 96 for a light alarm.

Those persons skilled in the art desiring more detailed information for the 555 timer are referred to the National Semiconductor Linear Data Book--1983 and the ICM 7555 item of the Intersil Data Book, and U.S. Pat. No. 4,800,292 issued Jan. 24, 1989, to Gillett for a Temperature Sensing Circuit.

Lead 98 connects the voltage regulator 5 V output to the junction of the power on indicating circuit 100 and the gas detection circuit 102. The power on indicating circuit includes a green LED 104 having its anode connected to power lead 98 and cathode connected through a 470 ohm resistor 106 to ground.

The gas detection circuit 102 includes a TGS 813 tin dioxide semiconductor combustible gas sensor 42 having its heater resistive circuit and first detector electrode of first and second electrodes connected to lead 98 for receiving operating power. The heater resistive circuit is for heating the sensor to its optimum natural gas concentration detection resistance (about 3.8K ohms), thereby minimizing false gas detection. The second electrode of the sensor is connected to the junction of lead 88 and positive end of a 7.5 K load resistor 108. The resistor 108 has its negative end connected to ground. Thus, the sensor resistance and load resistance provides an external resistor network producing $\frac{2}{3}$ and $\frac{1}{3}$ set point resistances to the trigger and threshold pins (2,6) for the two comparators of the 555 timer. These voltages correspond to the $\frac{2}{3}$ and $\frac{1}{3}$ ratios of the 555 timer's internal resistance networks connected to Vcc and providing the reference voltages to the comparators of the 555 timer.

In operation when the circuit is powered on the sensor resistance goes from about zero resistance to a very high resistance as the senor absorbs oxygen. The sensor resistance stabilizes at a resistance higher than the 3.8K ohms required for the 5,000 ppm gas concentration detection. During the rise time from zero to about 3.8K ohms resistance ($\frac{2}{3}$ set point of the 555 timer) the latch goes high and a false alarm is indicated. This false alarm should cease when the sensor resistance rises above the 3.8K ohms and the latch goes low. The sensor stabilizes at the 15K ohm resistance ($\frac{1}{3}$ point of the 555 timer). Thus, the false alarm signal provides a fail safe feature for the apparatus. The alarm remains off while the resistance is falling owing to an increase in gas concentration, but when the resistance falls to the $\frac{2}{3}$ point, the 5,000 ppm gas concentration has been detected and the latch goes high to activate the alarms.

Although several embodiments of this invention have been described, it will be apparent to a person skilled in the art that various modifications to the details of construction shown and described may be made without departing from the scope of this invention.

What is claimed is:

1. A hazardous gas detection apparatus comprising:

a housing means for housing a regulated power source, a signal processing circuit, and an alarm circuit; and a probe means including a housing located exteriorly of the housing means, a tin dioxide semiconductor sensor mounted in the housing and having a preselected resistance for detecting a hazardous gas at a preselected concentration below its lower explosive limit, and electrical leads connected to the regulated power source and signal processing circuit;

said signal processing circuit having a resistor network including the gas sensor and a load resistance of preselected value for setting first and second gas concentration voltage set point gas concentrations, and a 555 timer having its trigger and threshold inputs coupled to the resistor network for monitoring first and second voltages from the resistor network, said 555 timer outputting first and second logic state output signals indicative, respectively, of gas concentration in clean air and gas concentration at a preselected gas concentration below the lower explosive limit of the gas; and said alarm circuit including a sound producing means connected to the output of the 555 timer for producing a sound alarm when the preselected gas concentration is detected.

2. A hazardous gas detection apparatus according to claim 1, wherein the sensor and load resistor are connected in series and voltages are generated at a first node between the sensor and load resistor, said threshold and trigger inputs are connected to the node.

3. A hazardous gas detection apparatus according to claim 1 wherein the alarm circuit includes a light emitting diode connected to the output of the 555 timer for producing a light alarm when the preselected gas concentration is detected.

4. A hazardous gas detection apparatus according to claim 1 wherein the alarm circuit includes a buzzer and a light emitting detector connected to the output of the 555 timer for producing a sound alarm and a light alarm.

5. A hazardous gas detection apparatus according to claim 1 wherein the housing means further includes a power on light indicator connected to the regulated source of power for indicating an operable power source.

6. A hazardous gas detection apparatus comprising:

a housing means for housing at least two power regulators, two signal processing circuits and two alarm circuits; and at least two probe means including two housings located exteriorly of the housing means and each other for detection of a hazardous gas in at least two separate locations, each probe housing having a tin dioxide semiconductor sensor mounted therein and having a preselected resistance for detecting a hazardous gas at a preselected concentration below its lower explosive limit, and electrical leads connected to a corresponding power regulator and signal processing circuit;

each signal processing circuit having a resistor network including the gas sensor and a load resistance of preselected value for setting first and second gas concentration voltage set point gas concentrations, and a 555 timer having its trigger and threshold inputs coupled to the resistor network for monitoring first and second voltages from the resistor network, said 555 timer outputting first and second state output signals indicative, respectively, of gas concentration in clean air and gas concentration at a preselected gas concentration below the lower explosive limit of the gas; and each of said alarm circuits including a light producing alarm means connected to the output of the 555 timer for producing a light signal indicating the location of the gas concentration when the preselected gas concentration is detected.

7. A hazardous gas detection apparatus according to claim 6, wherein each of the alarm circuits further include a buzzer connected to a corresponding output of a 555 timer of the corresponding signal processing circuit for producing a sound alarm when the preselected gas concentration has been detected.

8. A hazardous gas detection apparatus according to claim 6, wherein each of the alarm circuits include light and sound alarms connected to the output terminal of the 555 timer of the corresponding signal processing circuit for producing light and sound alarms.

9. A hazardous gas detection apparatus according to claim 6 wherein the first probe and the second probe of the at least two probes are mounted, respectively, under the hood adjacent to the fuel system of an engine, and in the trunk adjacent to the natural gas tank of a vehicle, and the housing means is mounted in or under the dashboard of the vehicle.

10. A method of detecting the presence of a hazardous gas in a preselected concentration substantially below the lower explosive limit of the gas consisting of the steps of:

a) sensing the presence of a hazardous gas using a hazardous gas sensitive resistor network having a tin dioxide semiconductor sensor connected in series with a load resistor of a preselected resistance value for outputting at the junction thereof the voltages indicative of the presence and concentration of the hazardous gas;

b) connecting the resistor network output signals to the trigger and threshold inputs of a 555 timer circuit so that upon power up a first state is output indicating falsely the presence of a hazardous gas in concentrations above a preselected gas detection concentration until a preselected gas concentration is reached and then a second state output is generated while the sensor stabilizes at its highest resistance level in clean air and then in the presence of the hazardous gas in increasing concentrations returns to the preselected gas concentration at which point the output returns to the first state to indicate the presence of the hazardous gas above the preselected set point; and c) connecting an alarm to the output of the 555 timer so that the timer output state provides an alarm output for activating the alarm.

11. A method of detecting in a vehicle the presence of a hazardous gas in a preselected concentration substantially below the lower explosive limit of the gas consisting of the steps of:

a) sensing the presence of a hazardous gas under a vehicle hood and in a vehicle trunk using first and second probes positioned, respectively, adjacent to and slightly above the fuel injection system of an engine under the hood, and a natural gas tank in the trunk, said probes having tin dioxide semiconductor gas sensors mounted therein and connected in series with load resistors, said sensors and load resistors forming resistor networks outputting at their nodes voltages indicative of the presence and concentration of the hazardous gas;

b) connecting the resistor networks voltage outputs to the trigger and threshold inputs of 555 timer circuits so that upon power of a first state is output indicating falsely the presence of a hazardous gas in concentrations above a preselected gas detection concentration until a preselected gas concentration is reached and then a second state output is generated while the sensor stabilizes at its highest resistance level in clean air and then in the presence of the hazardous gas in increasing concentrations returns to the preselected gas concentration at which point the output returns to the first state to indicate the presence of the hazardous gas above the preselected set point; and connecting alarms mounted in or under the dashboard to the output of the 555 timers so that the timer' output state provides alarm outputs for activating the alarms as appropriate for indicating the locations of any gas concentrations at the preselected gas concentration.

* * * * *

UNITED STATES PATENT AND TRADEMARK OFFICE

CERTIFICATE OF CORRECTION

PATENT NO. : 5,218,347
DATED : June 8, 1993
INVENTOR(S) : Deppe

It is certified that error appears in the above-indentified patent and that said Letters Patent is hereby corrected as shown below:

On the title page, under "Other Publications," in the Watson, J., et al. article, line 2, change "On" between "gases" and "Radio" to --In--.

In column 9, line 1, delete "of" and add --up--.

In column 10, line 5, delete "timer'" and add --timers'--.

Signed and Sealed this

Fourth Day of January, 1994

Bruce Lehman

*Attest:*

BRUCE LEHMAN

*Attesting Officer*

*Commissioner of Patents and Trademarks*